US008282585B2

(12) United States Patent
Ding et al.

(10) Patent No.: US 8,282,585 B2
(45) Date of Patent: Oct. 9, 2012

(54) MASSAGER

(76) Inventors: Jane Ding, Dublin, CA (US); Yu Bo Ding, Hangzhou Zhe Jian Province (CN)

( * ) Notice: Subject to any disclaimer, the term of this patent is extended or adjusted under 35 U.S.C. 154(b) by 355 days.

(21) Appl. No.: 12/702,931

(22) Filed: Feb. 9, 2010

(65) Prior Publication Data

US 2011/0196274 A1 Aug. 11, 2011

(51) Int. Cl.
*A61H 7/00* (2006.01)

(52) U.S. Cl. ..... 601/136; 601/126; 601/134

(58) Field of Classification Search ..... 601/19, 601/27, 70, 86–88, 97, 101, 103, 130, 134, 601/136, 144, 126
See application file for complete search history.

(56) References Cited

U.S. PATENT DOCUMENTS 6,837,861 B2 * 1/2005 Lin ..... 601/87
7,037,279 B2 * 5/2006 Kim ..... 601/18
2002/0156404 A1 * 10/2002 Kuo ..... 601/86
2003/0009117 A1 * 1/2003 Zou ..... 601/134
2003/0018284 A1 * 1/2003 Lim ..... 601/98
2005/0256434 A1 * 11/2005 Luo ..... 601/86
2006/0069331 A1 * 3/2006 Huang ..... 601/90
2006/0211962 A1 * 9/2006 Ferber et al. ..... 601/86
2009/0227915 A1 * 9/2009 Chiang ..... 601/115

* cited by examiner

*Primary Examiner* — Nicholas Lucchesi
*Assistant Examiner* — Gerald Landry, II
(74) *Attorney, Agent, or Firm* — Dahyee Law Group; Leon E. Jew

(57) ABSTRACT

A massager system includes one or more gear trains coupled to a motor to rotate at least a pair of shafts that each supports a pair of nodules for rotation about the associated shaft. A pillow-shaped outer housing surrounds the motor and number of coupled gear trains with the nodules protruding above the outer housing to facilitate contact with a selected bodily region to knead or otherwise stimulate surface skin in a bodily region.

5 Claims, 5 Drawing Sheets

MASSAGER

FIELD OF THE INVENTION

The invention relates to body massagers and more particularly to massagers including mechanical actuators.

BACKGROUND OF THE INVENTION

Massaging of various regions of the body is considered to be beneficial for relaxing tense muscles structures and for promoting a sense of emotional tranquility and relaxation. Traditionally, body massages are performed by a trained masseur or masseuse who knead or rub regions of the body to promote the beneficial effects of massage. However, in the absence of such trained individuals, mechanical massagers have evolved to perform various forms of dynamic movements in contact with the body.

SUMMARY OF THE INVENTION

In accordance with one embodiment of the present invention, a mechanical massager incorporates a plurality of rotating nodules that may be positioned against selected surface regions of the body to mechanically knead the surface skin and associated subcutaneous muscle structures. The mechanical massager may be disposed within a pillow-shaped housing for convenient placement on or against selected body regions, with the rotating nodules disposed within or beneath a flexible membrane that is positioned against the body. Additionally sets of rotating nodules incorporate electrical heating elements to elevate the surface temperature for warming a body region disposed in close proximity to the rotating nodules.

DETAILED DESCRIPTION OF THE INVENTION

Figure 1:
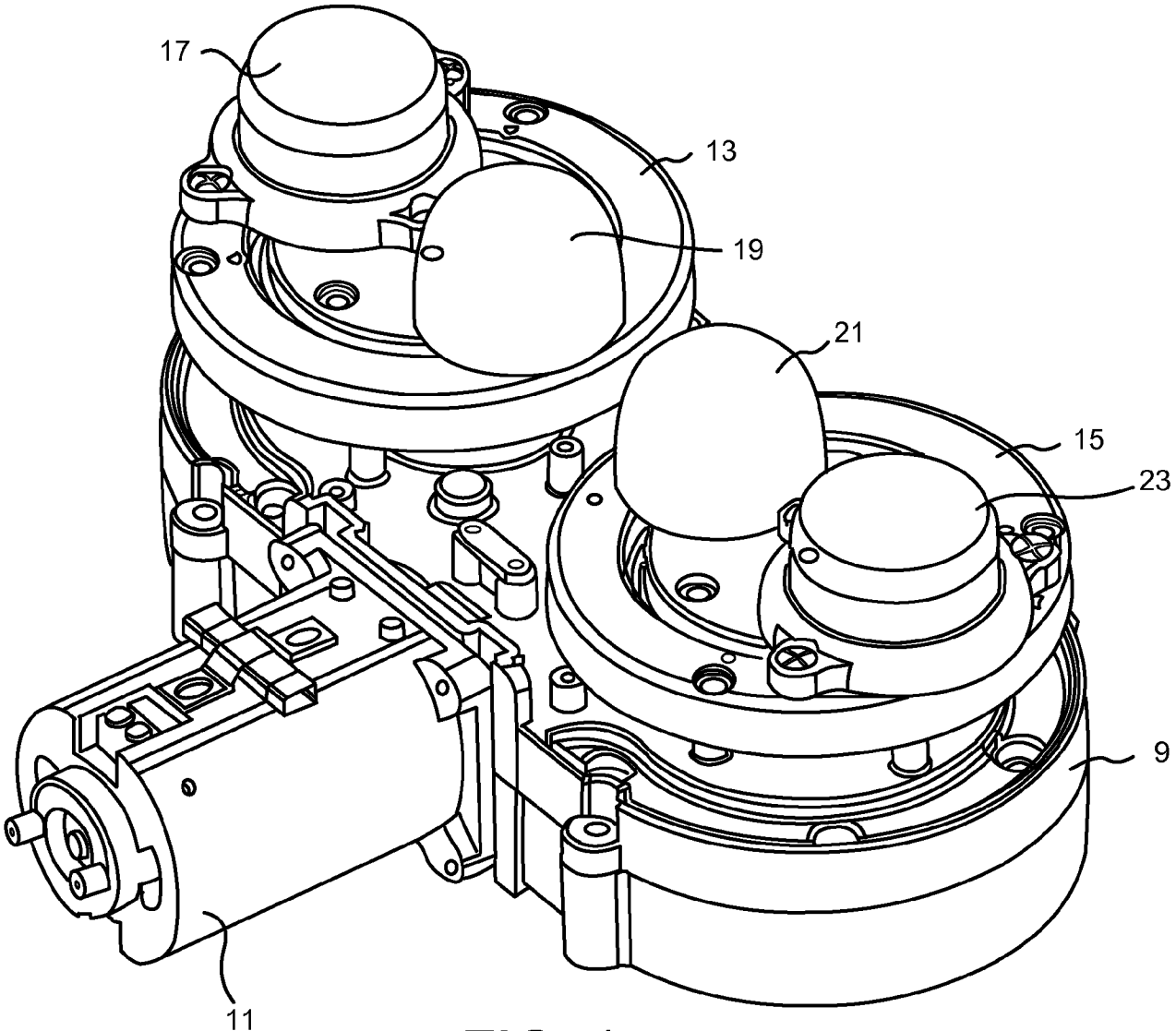
FIG. 1 is a perspective view of one embodiment of a mechanical massager comprising two pairs of rotable nodules.

Referring now to the perspective view of FIG. 1, there is shown a gear housing 9 and motor 11 forming the motive force for rotating the pair of discs 13, 15 that are attached to upstanding shafts 16, 18 and that each support a pair of nodules 17, 19 and 21, 23.

The nodules 17, 19 and 21, 23 thus mounted are rotable on the discs 13, 15, for example, in opposite rotational directions in response to energizing the motor 11 to rotate in one or opposite directions.

Figure 2:
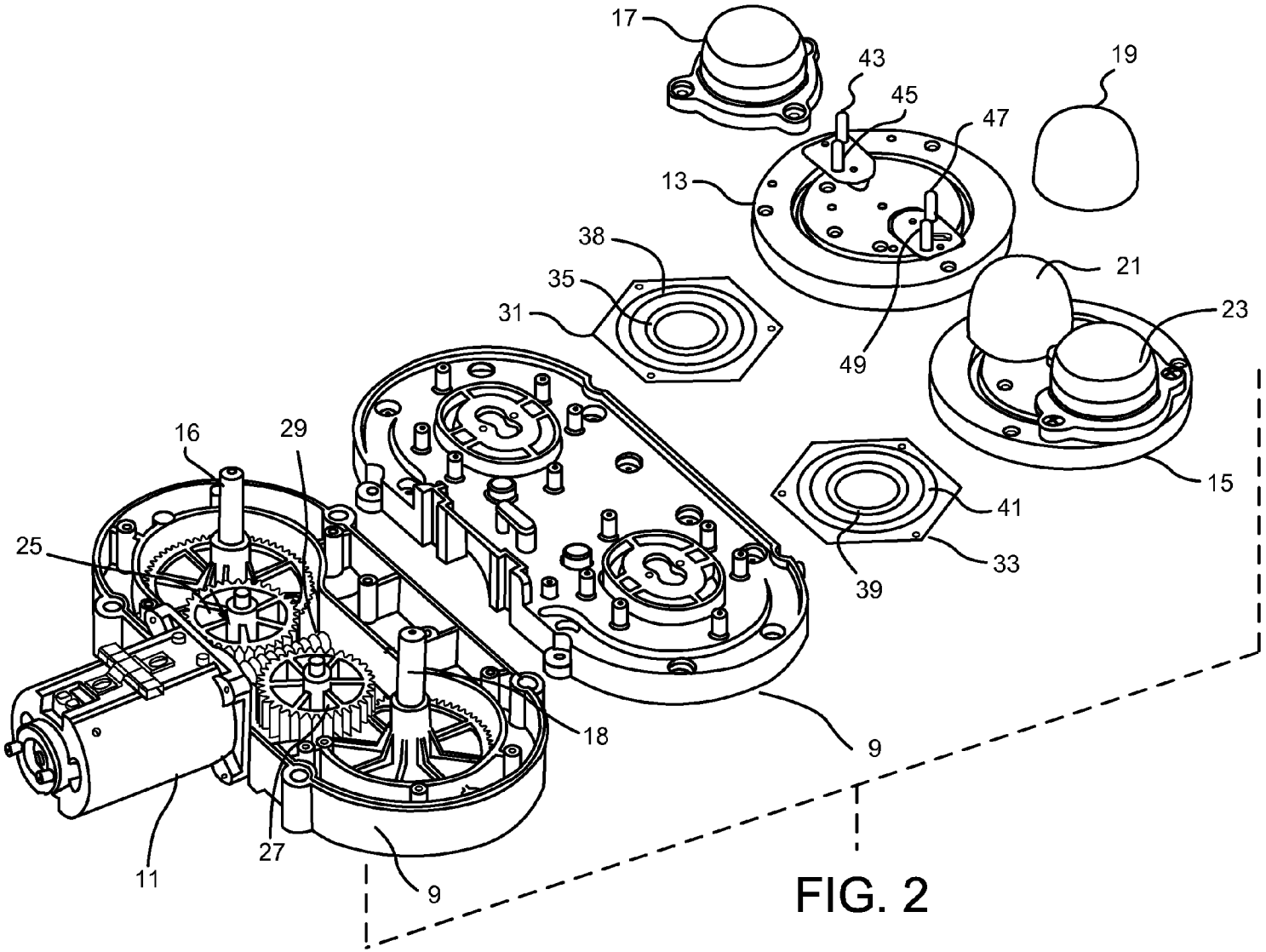
FIG. 2 is an exploded view of the embodiment illustrated in FIG. 1.

As illustrated in the exploded perspective view of FIG. 2, the gear housing 9 rotationally supports a pair of gear trains 25, 27 that couple a worm gear 29 driven by motor 11 to the upstanding shafts 16, 18 on which the discs 13, 15 are mounted. Thus, energizing motor 11 causes rotation of the discs 13, 15 in opposite directions. The housing 9 also supports electrical connection plates 31, 33 in concentric orientation about the respective shafts 16, 18. Each electrical connector plate 31, 33 includes concentric conductive channels 35, 38 and 39, 41 that provide electrical conduction to a pair of brushes 43, 45 and 47, 49 associated with each nodule 17, 19 and 21, 23 on each disc 13, 15. Heating elements and/or lighting components (not shown) may be disposed within each nodule 17, 19 and 21, 23 to enhance sensor stimulation or visual impact of the rotable nodules 17, 19 and 21, 23. The nodules may be formed of, for example, polyvinylchloride, polypropylene, or the like plastic or polished jade stones. It is believed that jade stones, heated to elevated temperatures that are comfortable to the human body, may promote transfer of trace minerals such as calcium, magnesium and iron to a bodily region in contact or in close proximity to the heated jade nodules.

Figure 3:
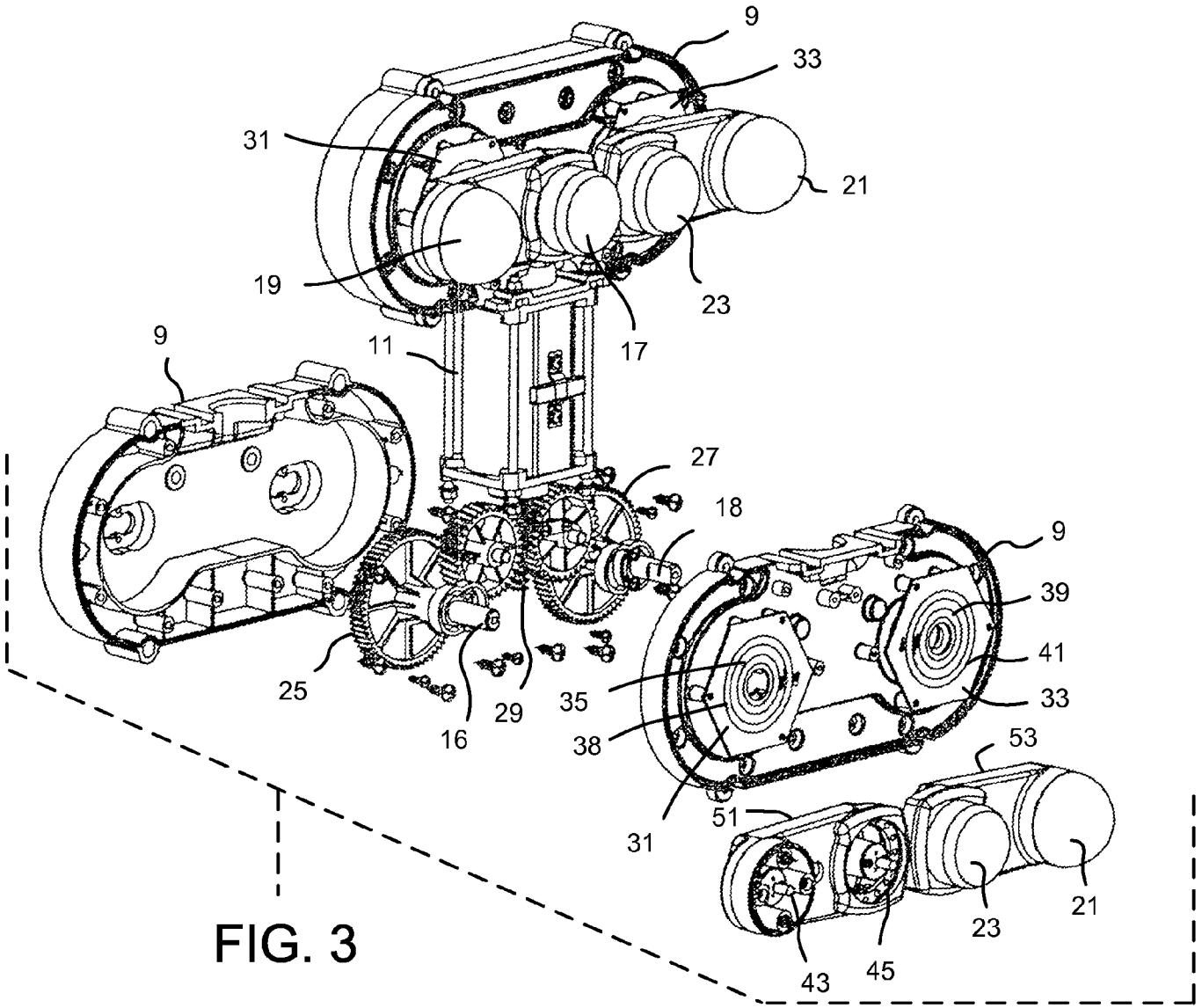
FIG. 3 is a perspective exploded view of another embodiment of a mechanical massager, including four pairs of rotable nodules.

Referring now to FIG. 3, there is shown an exploded perspective view of a dual or tandem configuration similar to the embodiment of FIGS. 1 and 2. Specifically, a pair of gear housings 9 are mounted to opposite ends of the motor 11 that includes worm gears 29 at each end shaft. The engaged gear trains 25, 27 in each gear housing 9 rotate shafts 16, 18 in response to energization of the motor 11. Electrical connection plates 31, 33 are disposed with conductive channels 35, 38 and 39, 41 in concentric orientation about the shafts 16, 18. Nodules 17, 19 and 21, 23 are mounted on platforms 51, 53 attached to the shafts 16, 18 for opposite rotations in response to energization of the motor 11. Electrical contact brushes 43, 45 may be disposed to connect to the conductive channels 35, 38 as the platforms 51, 53 rotate in order to supply electrical power therethrough to heaters and/or lighting systems in the nodules 17, 19 and 21, 23. The dual or tandem configuration of gear housings and associated rotatable nodules greatly facilitate the total area of a selected bodily region that can be massaged or otherwise stimulated by contact with the structure.

Figure 4:
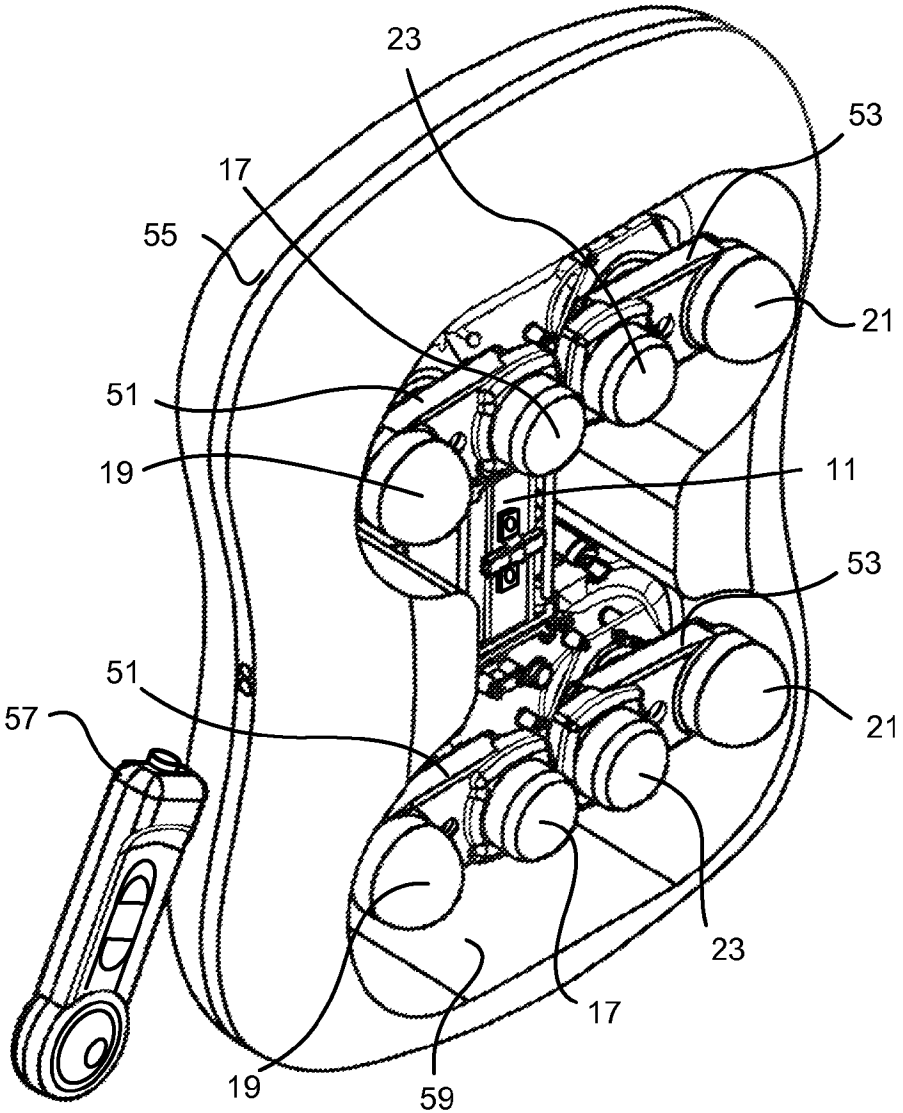
FIG. 4 is a perspective view of the embodiment of FIG. 3 disposed within a pillow-shaped outer housing.

Referring now to the partial perspective view of FIG. 4, there is shown an embodiment of FIG. 3 disposed within a recess 59 in pillow-shaped outer housing 55 that surrounds the structure with sufficient relief around the nodules 17, 19, 21, 23 and supporting platforms 51, 53 to facilitate unobstructed rotation thereof. The outer housing 55 may be relatively soft and pliant to comfortably conform to a selected bodily region, but also relatively firm to inhibit crushing or deformation and obstruction of the rotatable members. A manual controller 57 may be wired to the structure, or arranged for conventional remote control of rotations, rotation rate and time, heating and/or lighting of the nodules 17, 19, 21, 23.

Figure 5:
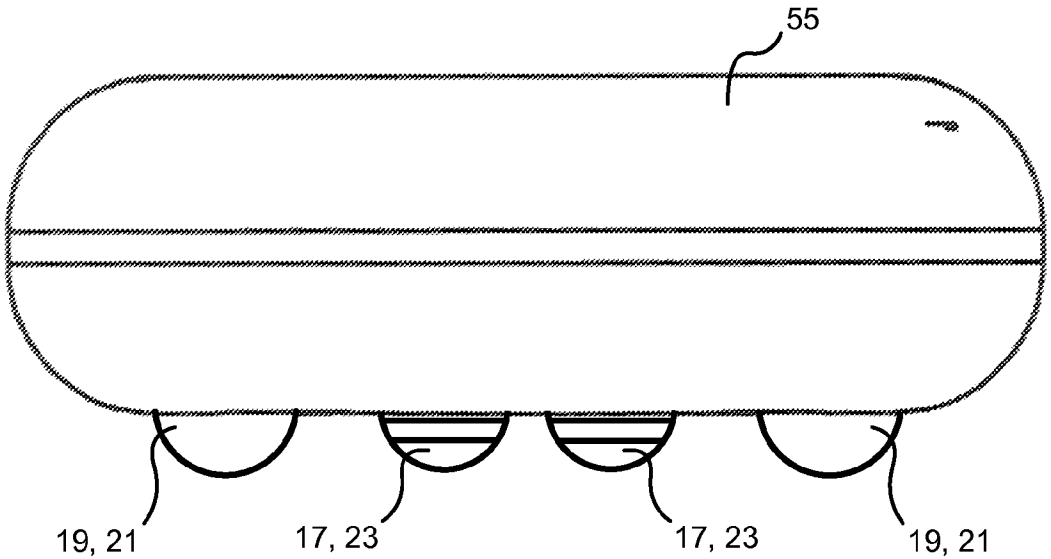
FIG. 5 is a side view of the embodiment of FIG. 4, illustrating the protruding nodules for placement proximate a selected body region.

Referring now to the side view of FIG. 5, there is shown a profile of the outer housing 55 and the nodules 17, 19, 21, 23 protruding beyond an outer surface of the outer housing to facilitate engagement of the nodules with a selected bodily region. A flexible membrane (not shown to promote clarity) is disposed over the nodules 17, 19, 21, 23 to enclose the recess 59 within the outer housing 55 in which the structure is disposed. Such membranes may be formed, for example, of fabric webbing or rubber sheet, or the like, to promote sanitary environment and obscure the recess 59 and the structure disposed therein.

Figure 6:
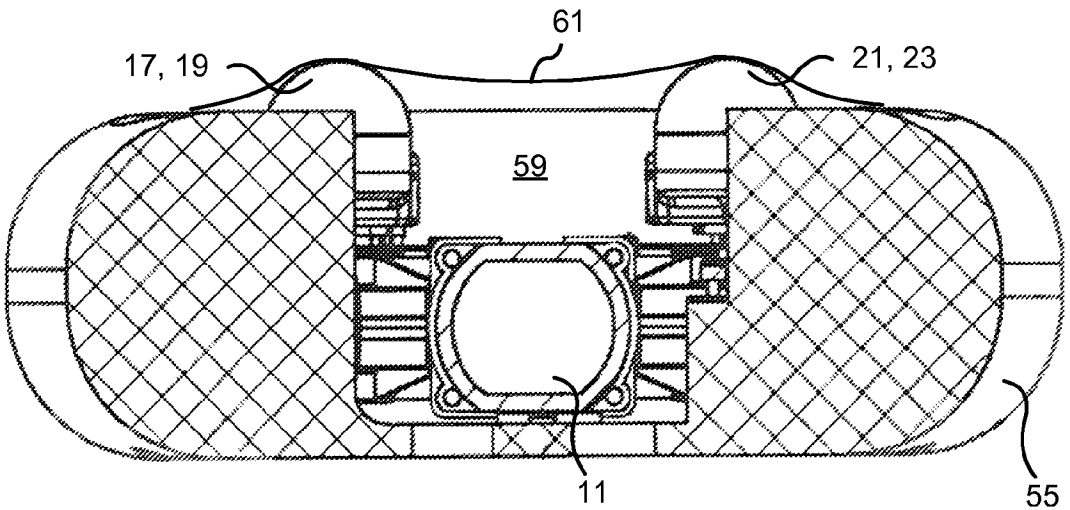
FIG. 6 is an end sectional view of the embodiment of FIG. 4, illustrating the orientation of components within a pillow-shaped outer housing, incorporating a flexible membrane disposed over the rotable nodules.

Referring now to the end sectional view of FIG. 6, there is shown the motor 11 and attached gear housing 9 disposed within the recess 59 in the pillow-shaped outer housing 55, with the upper surfaces of the nodules 17, 19, 21, 23 protruding above the outer housing from beneath the flexible membrane 61.

Therefore, the massager of the present invention incorporates a motor and engaged gear trains to rotate pairs of nodules that protrude from within a pillow-shaped outer housing to facilitate convenient kneading or other stimulation of a selected bodily region that is positioned in contact with the protruding nodules.

What is claimed is:

1. A massage system comprising: a motor engaged with a pair of gear trains to rotate two pairs of shafts in response to energization of the motor, a pair of nodules mounted on each of the shafts in spaced-apart relationship about an associated shaft, an outer housing disposed about the motor and gear trains and having a surface above which the nodules protrude, said outer housing having a flexible membrane disposed on said surface overlaying the nodules, a heater disposed within at least one of the pair of nodules, an electrically conductive channel disposed concentrically about each of said shafts, and electrical connections including a rotatable contact connecting the conductive channel to the heater within the nodule during rotation thereof about the associated shaft; wherein each of said nodules has a smooth surface that protrudes above the surface of the outer housing; and wherein each pair of the shafts are rotated in opposite directions.

2. The massage system as in claim 1 in which at least one of the nodules includes jade forming the surface of the nodule that protrudes above said surface of the outer housing.

3. The message system as in claim 1 in which each of the gear trains is disposed within a gear housing attached to the motor.

4. The massage system as in claim 1 in which the two pairs of shafts are substantially, parallel oriented to rotatably support the pairs of nodules thereon to rotate within substantially a common plane with the associated nodules protruding above said surface of the outer housing.

5. The massage system as in claim 1 in which the outer housing includes below said surface a recess containing the motor and gear train and nodules, and including said flexible membrane disposed over the recess and nodules.

* * * * *